US011098494B2

(12) United States Patent
Lesage

(10) Patent No.: US 11,098,494 B2
(45) Date of Patent: Aug. 24, 2021

(54) PROFILE, FRAME AND PROMOTION BOOTH FOR THE CONSTRUCTION OF STANDS AND/OR FOR INTERIOR APPLICATIONS AND/OR FOR EXTERIOR APPLICATIONS, A METHOD FOR MAKING THE PROFILE AND A USE OF THE PROFILE

(71) Applicant: ALUVISION, Deinze (BE)

(72) Inventor: Michiel Lesage, Deinze (BE)

(73) Assignee: ALUVISION, Deinze (BE)

( * ) Notice: Subject to any disclaimer, the term of this patent is extended or adjusted under 35 U.S.C. 154(b) by 0 days.

(21) Appl. No.: 16/483,694

(22) PCT Filed: Feb. 8, 2018

(86) PCT No.: PCT/IB2018/050782
§ 371 (c)(1),
(2) Date: Aug. 5, 2019

(87) PCT Pub. No.: WO2018/146611
PCT Pub. Date: Aug. 16, 2018

(65) Prior Publication Data

US 2020/0131790 A1 Apr. 30, 2020

(30) Foreign Application Priority Data

Feb. 8, 2017 (BE) ..... 2017/5079

(51) Int. Cl.
*E04H 1/12* (2006.01)
*E04C 3/06* (2006.01)
(Continued)

(52) U.S. Cl.
CPC ..... *E04H 1/1272* (2013.01); *E04C 3/06* (2013.01); *E04C 3/32* (2013.01);
(Continued)

(58) Field of Classification Search
CPC ..... E04H 1/1272; E04H 15/644; E04C 3/06; E04C 3/32; E04C 2003/043;
(Continued)

(56) References Cited

U.S. PATENT DOCUMENTS 3,789,563 A * 2/1974 Toti ..... B21D 47/04 52/839
3,811,212 A * 5/1974 Wright ..... G09F 13/10 40/367
(Continued)

FOREIGN PATENT DOCUMENTS

BE 1020560 A3 12/2013
DE 4029281 A1 3/1992
DE 202007004795 U1 7/2007

OTHER PUBLICATIONS

International Search Report and Written Opinion dated Apr. 23, 2018, issued in corresponding International Application No. PCT/IB2018/050782, filed Feb. 8, 2018, 12 pages.
(Continued)

*Primary Examiner* — Theodore V Adamos
(74) *Attorney, Agent, or Firm* — Christensen O'Connor Johnson Kindness PLLC

(57) ABSTRACT

A profile for the construction of stands for affixing booth elements includes an affixing side wall extending along a first direction of the profile. The affixing side wall is provided with an affixing surface for affixing a strip to the profile between a first affixing side wall edge and a second opposite affixing side wall edge. The affixing surface extends along the first direction of the profile, and is at least partly bordered by at least one flange for flangingly affixing the strip by flanging over the flange.

12 Claims, 5 Drawing Sheets

(51) Int. Cl.
*E04C 3/32* (2006.01)
*E04C 3/04* (2006.01)

(52) U.S. Cl.
CPC ..... *E04C 2003/0421* (2013.01); *E04C 2003/0439* (2013.01); *E04C 2003/0465* (2013.01)

(58) Field of Classification Search
CPC ..... E04C 2003/0421; E04C 2003/0439; E04C 2003/0465; E06B 3/16; E06B 3/721; E04B 1/0046; E04B 9/303; E04B 2009/0492
See application file for complete search history.

(56) References Cited

U.S. PATENT DOCUMENTS 3,999,354 A * 12/1976 Anter ..... B21D 47/04 52/844
4,018,260 A * 4/1977 Baslow ..... B25B 27/0092 160/327
5,067,543 A * 11/1991 Bove ..... E04B 2/7429 160/135
5,134,822 A * 8/1992 Edlin ..... B44C 7/022 160/327
5,230,377 A * 7/1993 Berman ..... E04B 9/303 160/327
6,601,362 B1 * 8/2003 Prince ..... E04C 3/06 52/844
7,735,540 B2 * 6/2010 Armstrong ..... E06B 9/24 160/328
D699,536 S * 2/2014 Waddell ..... E04B 9/303 D8/72
9,228,600 B2 * 1/2016 Frey ..... G09F 15/0018
2003/0089054 A1 * 5/2003 Hornung ..... E06B 3/24 52/204.62
2007/0294980 A1 * 12/2007 Coley ..... G09F 15/0012 52/745.19
2010/0108114 A1 5/2010 Hamilton-Jones
2010/0206364 A1 * 8/2010 Armstrong ..... E06B 9/52 136/252
2011/0094135 A1 * 4/2011 Frey ..... G09F 7/00 40/605
2012/0036755 A1 * 2/2012 Frey ..... G09F 15/0012 40/729
2013/0048812 A1 * 2/2013 Lozano ..... H05K 5/0204 248/220.22
2014/0157517 A1 * 6/2014 Cohen ..... A47G 9/04 5/498
2020/0392727 A1 * 12/2020 Fatcheric ..... E04F 13/0882

OTHER PUBLICATIONS

"Omni-55 A3 Profile", Internet Citation, Jan. 12, 2015, XP002750922, Retrieved from the Internet: URL: http://www.aluvision.com/en/Products/omni-55/omni-vision-a3-profile/[retrieved on Nov. 10, 2015].
International Preliminary Report on Patentability dated Mar. 20, 2019, issued in corresponding International Application No. PCT/IB2018/050782, filed Feb. 8, 2018, 17 pages.

* cited by examiner

PROFILE, FRAME AND PROMOTION BOOTH FOR THE CONSTRUCTION OF STANDS AND/OR FOR INTERIOR APPLICATIONS AND/OR FOR EXTERIOR APPLICATIONS, A METHOD FOR MAKING THE PROFILE AND A USE OF THE PROFILE

TECHNICAL FIELD

The present invention relates to a profile for the construction of stands and/or for interior applications and/or for exterior applications as described in the preamble of the first claim. The invention also relates to a frame and a promotion booth for the construction of stands. Moreover, the invention also relates to a method for making the profile and a use of the profile.

STATE OF THE ART

For various interior applications and/or for exterior applications and/or for making booths, e.g. promotion booths, as used at trade shows, exhibitions, events, etc., use is often made of profile elements, optionally provided with booth elements such as lighting, a plate or a curtain, for forming a frame consisting of at least one profile. One or more frames can be constructed into a stand construction element such as a promotion booth for use at a trade show.

In the state of the art, such profiles are known e.g. from the patent application BE1020560, wherein a profile for the construction of stands for affixing booth elements is described. The profile for the construction of stands comprises a first side wall, a second, opposing side wall and a third side wall connecting the first and second side walls, wherein these side walls extend along a first direction of the profile. Such profiles are often provided with a continuous affixing surface onto which a strip, e.g. a hook-and-loop fastener strip or a magnetic strip, is applied using chemical adhesion means such as glue. The strip applied onto the affixing surface of the profile allows a booth element, e.g. a plate, to be affixed to the profile for forming a frame and/or wand.

Setting up a stand construction element, e.g. at a trade show, is carried out by assembling the profiles into frames and the frames into the stand construction element. To that end, at the start of the trade show, the profiles are laid out according to a pattern that is specific to the promotion booth to be constructed. The profiles are optionally connected to each other using connection elements for forming frames that consist e.g. of combinations of profiles such as corners or borders. Then, optionally, booth elements such as lighting elements, curtains or plates are affixed to the profile for forming the stand construction element. To that end, the booth elements in the state of the art are provided with a strip, e.g. a layer of hook-and-loop fastener, which is coupled to the strip of the profile, e.g. also a layer of hook-and-loop fastener, e.g. by pressing the two layers of hook-and-loop fastener together.

Such a stand construction element is often designed by e.g. a design agency before the start of e.g. the trade show, often with the aim of providing a personalized stand construction element. For that purpose, the stand construction element is designed at the level of frame assemblies and corresponding profile sizes. To that end, the profiles are sawn to the correct size and shape by means of a sawing device, e.g. to a length of 1 meter or e.g. at an angle of 45° for forming a corner element when combined with a second profile sawn at an angle of 45°. However, when sawing the profiles to achieve the correct profile shape and profile length, the profiles of the state of the art exhibit the disadvantage that due to the sawing, e.g. due to the heat caused by the sawing, the chemical adhesion means applied onto the affixing surface for affixing the strip to the latter at least partly detaches from the affixing surface and e.g. spatters away and adheres to or inside the sawing device and onto unforeseen places on the profile, e.g. on places other than the affixing surface. The chemical adhesion means adhering onto and inside the sawing device has detrimental consequences for the sawing device, such as an increased rotational resistance of the sawing disk, e.g. causing increased wear. Moreover, this requires a labor-intensive and costly process to be carried out afterward for removing the chemical adhesion means adhering inside or onto the sawing device and at unforeseen places on the profile.

A possible solution to this problem is to apply the chemical adhesion means, and thus a fortiori the strip, after sawing the profile to the correct profile length and profile shape. This solution, however, entails that a strip applied in such a way onto the profile will exhibit a lower degree of finish than a strip applied before the sawing. The explanation for this lies, among other things, in the difficulty of cutting the strip to the likeness of the already cut profile. Furthermore, applying the strip after sawing the profile is a labor-intensive and costly process.

DESCRIPTION OF THE INVENTION

An aim of the present invention is to provide a profile for the construction of stands and/or for interior applications and/or for exterior applications with which the problem mentioned above is remedied. More in particular, the aim of the invention is to provide a profile for the construction of stands and/or for interior applications and/or for exterior applications for affixing booth elements, wherein the profile comprises an affixing side wall, wherein the affixing side wall is further provided with an affixing surface for affixing a strip to the profile, located between a first affixing side wall edge and a second, opposite affixing side wall edge, wherein the affixing surface extends along a first direction of the profile. Preferably, the profile comprises a further side wall, the first side wall, and more preferably another further side wall, the second side wall, extending along the first direction of the profile. The first side wall and the second side wall of the profile are located opposite each other and the affixing side wall forms a connection between the first side wall and the second side wall. The profile is characterized in that the affixing surface is at least partly bordered by at least one flange for flangingly affixing the strip by flanging over the flange. The flange is e.g. a protruding edge, such as for instance an edge that protrudes, e.g. perpendicularly, from a plane such as the affixing side wall. Flanging over comprises e.g. bending down the flange from a state wherein the flange protrudes from the plane, such as protruding from the affixing surface, to a state wherein the flange lies substantially in the plane, such as the affixing surface, and/or abuts the affixing surface.

The at least one flange being arranged for flangingly affixing the strip by flanging over the flange offers the advantage that when sawing off the profile using a sawing device to achieve a certain profile length and profile shape, no further measures are required for protection of e.g. the sawing device or the profile, e.g. for their protection against the adhesion of chemical adhesion means that could be released during sawing of the profile e.g. by heating of the chemical means as a result of frictional heat generated during sawing, which chemical adhesion means would be applied onto the affixing surface for affixing the strip. More in particular, the at least one flange offers the possibility to affix the strip onto the affixing surface without using chemical adhesion means that could for instance lead to the adhesion of chemical adhesion means onto or inside the sawing device or on unforeseen places on the profile during sawing.

A further advantage of the invention is that the risk of chemical adhesion means adhering inside or onto the sawing device is reduced, which reduces the risk of further detrimental consequences such as the risk of causing an increased rotational resistance of the sawing device.

A further advantage of the invention is that the at least one flange arranged for flangingly affixing the strip by flanging over the flange, can flangingly affix the strip before sawing the profile. More in particular, the invention offers the advantage that the strip can be flangingly affixed before sawing the profile, e.g. by clamping tight, by at least one flange, as a result of which, when sawing the profile, the strip is sawn to the exact same profile length and profile shape, leading to a precise finish of the profile. Furthermore, the labor-intensive and costly process in which after sawing the profile, the strip is cut off to size and is affixed to the profile in a precise manner, can be avoided.

In an embodiment of the profile according to the present invention, the affixing surface is provided with the flangingly affixed strip, flanged over by the at least one flanged-over flange.

The affixing surface that is provided with the flangingly affixed strip, flanged over by the at least one flanged-over flange, offers the advantage that when sawing off the profile using a sawing device to achieve a certain profile length and profile shape, no further measures are required for protection of e.g. the sawing device or the profile, e.g. for their protection against the adhesion of chemical adhesion means onto or inside the sawing device that could be released during sawing of the profile e.g. by heating of the chemical means as a result of frictional heat generated during sawing, which chemical adhesion means would be applied onto the affixing surface for affixing the strip. More in particular, the strip is affixed onto the affixing surface of the profile by the at least one flanged-over flange without using chemical adhesion means which could lead to the adhesion of chemical adhesion means onto or inside the sawing device or on unforeseen places on the profile during sawing.

A further advantage of the invention is that the risk of chemical adhesion means adhering inside or onto the sawing device is reduced, which reduces the risk of further detrimental consequences such as the risk of causing an increased rotational resistance of the sawing device.

A further advantage of the invention is that the strip is affixed onto the affixing surface by the at least one flanged-over flange before sawing the profile, as a result of which, when sawing the profile, the strip is sawn to the exact same profile length and profile shape, leading to a precise finish of the profile. Furthermore, the labor-intensive and costly process in which after sawing the profile, the strip is cut off to size and is affixed to the profile in a precise manner, is avoided.

A further advantage of the invention is that the strip affixed to the affixing surface by the at least one flanged-over flange exhibits a stable attachment, e.g. not affected by environmental factors such as the ambient temperature or the ambient humidity. The attachment of the strip is therefore a durable attachment, even after prolonged exposure to adverse environmental factors such as strongly varying temperatures and elevated levels of humidity.

In an embodiment of the profile according to the present invention, the strip comprises affixing means for affixing the booth element.

The affixing means offer the advantage that a booth element such as a curtain or a plate can be affixed to the profile. To this end, affixing means provided on a strip of the booth element can be coupled to the affixing means of the profile. The nature of the affixing means is stipulated in further embodiments.

In an embodiment of the profile according to the present invention, the affixing means are one or more of a hook-and-loop fastener strip, a magnetic strip and a metal strip.

The affixing means provided in the profile strip for affixing a booth element such as lighting, a curtain or a plate to the profile, can be of various nature. The affixing means provided in the strip of the profile can be of such a nature that they contain hook-and-loop fastener, e.g. the part with hooks or the part with loops. To this end, the affixing means present on the strip of the booth element may also be provided with hook-and-loop fastener, respectively the part with loops or the part with hooks, depending on the part applied to the strip of the profile, so that both parts can become entangled with each other, for said hook-and-loop fastener to be coupled, e.g. by pressing said hook-and-loop fastener, with the hook-and-loop fastener comprised in the affixing means of the strip affixed onto the profile. The affixing means provided in the strip of the profile can be of such a nature that it comprises a magnetic material. To this end, the affixing means present on the strip of the booth element may be provided with a material having e.g. ferromagnetic or magnetic properties, so that the magnetic material of the affixing means of the profile strip can be coupled, e.g. by magnetic attraction, to the material of the strip on the booth element. In addition, the affixing means of the profile strip and the strip of the booth element can respectively comprise a ferromagnetic material and a magnetic material. An advantage of the use of affixing means of that nature is that het ferromagnetic and magnetic materials is subject to less wear than the affixing means comprising hook-and-loop fastener, as the latter are for instance increasingly damaged with every separation and as dust may gather onto such affixing means. A further advantage of the magnetic affixing means is that the booth element does not need to be provided with a strip having affixing means such as a hook-and-loop fastener strip, as the material of the entire booth element can be made from ferromagnetic material.

In an embodiment of the profile according to the present invention, the strip is a lighting strip.

In addition to affixing means, the strip to be affixed to the profile may also comprise lighting means, e.g. LED lighting. The use of a lighting strip offers the advantage that the lighting is directly built into the profile, as opposed to attaching a lighting booth element provided with affixing means onto affixing means comprised in the affixing strip of the profile according to previous embodiments. An advantage of this embodiment is that, for instance, lighting is always provided in the profile, so that there is no risk of forgetting or losing the lighting booth elements.

In an embodiment of the profile according to the present invention, the at least one flange extends along the first direction of the profile. Preferably, the flange extends along the first direction of the profile over substantially the entire length of the profile, e.g. the entire length of the profile, preferably in a substantially continuous line, e.g. in a fully continuous line.

The advantage of the embodiment in which the at least one flange extends along the first direction of the profile, is that it becomes easy to firmly attach the strip to be affixed onto the affixing surface of the profile, which also extends in the first direction, by flanging over the at least one flange.

In an embodiment of the profile according to the present invention, the affixing surface is at least partly bordered by at least the previously discussed flange and a further, second flange.

Bordering the affixing surface, at least partly, by the first and second flanges offers the advantage that the strip can be affixed more securely to the affixing surface when compared to previous embodiments, by flangingly affixing the strip by flanging over the first and second flanges.

In an embodiment of the profile according to the present invention, the first and second flanges that at least partly border the affixing surface run parallel to each other.

Flangingly affixing the strip to the affixing surface by flanging over the first and second parallel flanges yields a sturdier attachment of the strip to the affixing surface when compared to other embodiments, such as flangingly affixing the strip to the affixing surface by flanging over the first and second flanges wherein the first and second flanges are perpendicular to each other. In the situation where the first and second flanges are perpendicular to each other, the strip retains a free, non-bordered corner. This free corner renders the strip more mobile over the affixing surface, which can lead to problems, e.g. in the case of a booth element such as a plate affixed to the profile strip, wherein the free corner of the profile strip may detach from the affixing surface, e.g. under the influence of the weight of the plate.

In an embodiment of the profile according to the present invention, the at least one flange extends in an upward direction relative to the affixing surface. More in particular, the present embodiment stipulates that the at least one non-flanged-over flange extends in an upward direction relative to the affixing surface.

The upward direction of the at least one flange allows the strip to be applied between the upright flange and the affixing surface, and to then flange the flange around the strip for affixing the strip to the affixing surface.

In an embodiment of the profile according to the present invention, when flanging over the at least one flange, the latter rotates about a rotational axis along the first direction, wherein the rotational axis preferably lies along the affixing surface.

The rotational axis for flanging over the at least one flange being positioned along the affixing surface offers the advantage that after flanging over the at least one flange for affixing the strip to the affixing surface using at least one flanged-over flange, the flanged-over flange is arranged substantially inside the affixing surface, e.g. is arranged inside the affixing surface. This allows the booth element, such as a curtain or a plate, to be easily coupled to the strip of the profile, as opposed to embodiments wherein the rotational axis of the at least one flange would for instance be arranged above the affixing surface, in which case the inclusion of an intermediate piece would be required between the rotational axis of the at least one flange and the affixing surface, which intermediate piece would complicate the coupling of the booth element, e.g. a rigid plate, to the strip.

In an embodiment of the profile according to the present invention, the affixing surface comprises at least one lowered platform which extends along the first direction over at least a part of the affixing surface along the at least one flange.

The lowered platform extending along the first direction over at least a part of the affixing surface along the at least one flange offers the advantage that after flanging over the at least one flange for affixing the strip to the affixing surface, the at least one flanged-over flange is positioned closer to the remainder of the affixing surface, e.g. positioned inside the remainder of the affixing surface, and preferably forms a continuous surface together with the remainder of the affixing surface, wherein the remainder of the affixing surface is contiguous with the at least one flanged-over flange. This allows the booth element, such as a curtain or a plate, to be easily coupled to the strip of the profile, as a good contact can be achieved between the booth element and the strip. A further advantage of the lowered platform extending along the first direction over at least a part of the affixing surface along the at least one flange is that when flanging over the at least one flange for affixing the strip to the affixing surface, the strip is pulled inside the lowered platform and is thus stretched out. This causes the strip to be tensioned, leading to a better contact and coupling with the booth element.

In an embodiment of the profile according to the present invention, the whole of the flange and the affixing surface are provided with at least one interlocking protrusion-indentation set, wherein when flanging over the flange toward the affixing surface, the protrusion and indentation interlock. Preferably, the flange and the affixing surface are respectively provided with a protrusion and an indentation.

The advantage of this embodiment is that the flangingly affixed strip, flanged over by the at least one flange, is attached more sturdily to the affixing surface when compared to embodiments wherein e.g. a pair of affixing surface and flange in level abutment is provided. More in particular, the protrusion-indentation set offers the advantage of a reduced risk of the flangingly affixed strip becoming detached from the affixing surface, e.g. by sliding away between the flanged-over flange and the affixing surface, e.g. due to the weight of the booth element such as a plate pulling on the strip.

In an embodiment of the profile according to the present invention, the protrusion-indentation set extends along the first direction of at least a part of the flange and the affixing surface.

Such an embodiment allows to e.g. extrude the protrusion-indentation set together with the flange.

In an embodiment of the profile according to the present invention, the at least one flange and the affixing surface form an angle between 5° and 175°, and more preferably the at least one flange and the affixing surface form an angle of 45°. More in particular, the present embodiment describes an angle between the at least one non-flanged-over flange and the affixing surface.

This embodiment allows the strip to be applied between the at least one non-flanged-over flange and the affixing surface, and the flange then to be flanged around the strip for affixing the strip to the affixing surface. More in particular, the optimal angle between the at least one non-flanged-over flange and the affixing surface is shown to be 45°, partly because at this angle, on the one hand, the strip can easily be applied between the at least one non-flanged-over flange and the affixing surface, and on the other hand, flanging over the at least one non-flanged-over flange at this angle is easily achieved. More in particular, on the one hand, at angles substantially smaller than 45°, applying the strip between the at least one non-flanged-over flange and the affixing surface is harder to carry out as there is less space available for applying the strip, and on the other hand, at angles substantially greater than 45°, the risk is increased that, when flanging over the at least one non-flanged-over flange, said flange is damaged, e.g. is broken off or weakened.

In an embodiment of the profile according to the present invention, the profile comprises a first side wall provided with a first first-side-wall edge and a second first-side-wall edge, wherein the first side wall extends along the first direction of the profile and wherein the first side wall is connected to the affixing side wall, and the first first-side-wall edge is for instance integral with the first affixing side wall edge. Providing the first side wall in connection with the affixing side wall offers the advantage, among other things, of yielding an increased bending resistance of the profile, which can be advantageous if, for instance, the profile is subjected to wear, for instance at a trade show or for instance under the load of the booth element such as the plate. More preferably the profile comprises a second side wall provided with a first second-side-wall edge and a second second-side-wall edge, wherein the second side wall extends along the first direction of the profile and wherein the second side wall is connected to the affixing side wall, and preferably the first second-side-wall edge is integral with the second affixing side wall edge. Adding the second side wall to the profile offers the advantage, among other things, of increasing even further the bending resistance of the profile. Preferably, the first side wall is connected to the second side wall and, for instance, the second first-side-wall edge and the second second-side-wall edge of the profile are integral. In this preferred embodiment, the first side wall, the second side wall and the affixing side wall of the profile thus form e.g. a triangular profile. Connecting the first side wall and the second side wall strengthens the profile, as it becomes more difficult to e.g. fold the first side wall or the second side wall about a rotational axis which coincides with respectively the first first-side-wall edge and the first second-side-wall edge. More preferably, the profile comprises a third side wall provided with a first third-side-wall edge and a second third-side-wall edge, wherein the third side wall extends along the first direction of the profile and wherein the third side wall is connected to the second side wall of the profile. Preferably, the first third-side-wall edge is integral with the second second-side-wall edge. Providing a third side wall in connection with the second side wall of the profile, and preferably connected in such a way that the first third-side-wall edge is integral with the second second-side-wall edge, offers the advantage that the bending resistance of the profile is increased. Preferably, the third side wall is also connected to the first side wall, and preferably the second third-side-wall edge and the second first-side-wall edge are integral, as connecting the side edges of the profile renders more difficult the folding of the first side wall, second side wall or third side wall, respectively about a rotational axis coinciding with the first first-side-wall edge, the first second-side-wall edge and the first third-side-wall edge. In further embodiments, the profile provided is with at least a further side wall, which extends in the first direction of the profile, wherein the at least one further side wall is connected to at least one of the other side walls of the profile.

In an embodiment of the profile according to the present invention, the profile provided with the first side wall according to previous embodiments comprises a further affixing surface on the first side wall. Providing a further affixing surface on the first side wall of the profile offers the advantage that two booth elements can be affixed to the profile. Preferably, the profile provided with the first side wall and the second side wall according to previous embodiments comprises at least one further affixing surface on at least one of the first side wall and the second side wall. Preferably, the profile provided with the first side wall, the second side wall and the third side wall according to previous embodiments comprises at least one further affixing surface on at least one of the first side wall, the second side wall and the third side wall. Providing a further affixing surface on the profile offers the advantage that multiple booth elements can be affixed to the profile. Preferably, the at least one further affixing surface is bordered by at least one flange according to previous embodiments. Providing the at least one flange offers the advantage that the strip can easily be affixed to the affixing surface of the profile.

In an embodiment of the profile according to the present invention, the affixing surface is an outer surface. The outer surfaces of the affixing side wall are determined based on the senses of the side walls connected to the affixing side wall, e.g. the first side wall or the first and second side walls. The senses of the side wall, e.g. positive, negative, or both, are equal to the senses of vectors described by an origin in an intersecting line formed by intersection of the affixing side wall and the side wall, and the edges of the side wall, projected onto the normal of the affixing side wall. Thus, the senses of the first side wall relative to the affixing side wall equal the senses of vectors described by an origin on an intersecting line formed by intersection of the affixing side wall and the first side wall, projected onto the normal of the affixing side wall. More in particular, the outer surfaces of the affixing side wall are determined as the surfaces of the affixing side wall of which the sense of the normal onto the surface is the same as at most one of the senses of the connected side walls. The outer surfaces of the subsequent side walls, e.g. the first side wall, the second side wall and the third side wall, are similarly determined based on the senses of the side walls connected to respectively the first side wall, the second side wall and the third side wall. The advantage of this embodiment is that an external affixing surface allows a booth element, such as a plate or a curtain, to be affixed to the affixing surface and to reach wider than the dimensions of the affixing side wall, e.g. not hindered by the first or second side wall.

Preferably, the first and second side walls together with the affixing side wall enclose a volume, and the outer surface of the affixing side wall is a surface of the affixing side wall facing away from the volume thus enclosed. The advantage of this embodiment is that an external affixing surface allows a booth element, such as a plate or a curtain, to be affixed to the affixing surface and to reach wider than the dimensions of the affixing side wall, e.g. not hindered by the first or second side wall.

In an embodiment of the profile according to the present invention, the affixing side wall is provided with a bordering plate for bordering the booth element, wherein the bordering plate is substantially perpendicular, preferably perpendicular to the affixing side wall at the level of one of the opposite first affixing side wall edge and the second affixing side wall edge, preferably on one of the opposite first affixing side wall edge and the second affixing side wall edge, and wherein the bordering plate comprises an inner bordering plate surface, facing the opposite affixing side wall edge. Preferably, the profile of which at least one further side wall, e.g. the first side wall, the second side wall or the third side wall, is provided with an affixing surface, is also provided with such a bordering plate, placed substantially perpendicular to this further side wall.

The side wall being provided with an affixing surface, e.g. the affixing side wall being provided with a bordering plate wherein the bordering plate is substantially perpendicular to the affixing side wall at the level of one of the two opposite edges of the affixing side wall, offers the advantage that the application of a booth element, such as a plate, can be bordered by the bordering plate, particularly by the inner bordering plate surface. This offers the advantage that the booth element, e.g. the plate, can be supported on the bordering plate, particularly if the latter is perpendicular to the affixing side wall and therefore requires less support from the affixing strip affixed to the affixing surface. More in particular, the bordering plate allows the shear forces exerted by the booth element such as the plate, e.g. under the influence of its weight, onto the affixing strip affixed to the affixing surface, to be substantially fully absorbed. This allows the affixing strip to be optimized for absorbing the normal forces exerted by the booth element such as the plate, e.g. under the influence of its weight, onto the affixing strip affixed to the affixing surface of the profile.

In an embodiment of the profile according to the present invention, the affixing side wall is provided with an affixing groove, for affixing therein an affixing part of the booth element such as an affixing pin of a curtain or a string attached to a curtain, for affixing this booth element to the profile. Preferably, the profile provided with at least one further side wall, e.g. the first side wall, the second side wall or the third side wall, is also provided with a further affixing groove. More preferably, the profile of which at least one further side wall, e.g. the first side wall, the second side wall or the third side wall is provided with a further affixing surface, is also provided with a further affixing groove on this further side wall. In an embodiment of the profile, a side wall is either provided with a bordering plate or provided with an affixing groove. Preferably, a side wall which is designed for affixing a plate is provided with a bordering plate, while a side wall which is designed for affixing a curtain is preferably provided with an affixing groove.

The side wall provided with an affixing surface, e.g. the affixing side wall provided with the affixing groove, allows the affixing part of the booth element, such as a curtain, to be arranged therein for affixing the curtain to the profile. This offers the advantage that the booth element, e.g. the curtain, can be supported on the affixing part arranged in the affixing groove, and therefore requires less support from the affixing strip affixed to the affixing surface. More in particular, the bordering plate allows the shear forces exerted by the booth element such as the curtain, e.g. under the influence of its weight, onto the affixing strip affixed to the affixing surface, to be substantially fully absorbed. This allows the affixing strip to be optimized for absorbing the normal forces exerted by the booth element such as the curtain, e.g. under the influence of its weight or under the influence of wind forces on the curtain, onto the affixing strip affixed to the affixing surface of the profile. The profile having a side wall either provided with a bordering plate or provided with an affixing groove, depending on the side wall being designed for affixing a plate or a curtain, offers the advantage that costs are reduced as only one of the two components needs to be provided on the side wall of the profile.

In an embodiment of the profile according to the present invention, the affixing side wall is provided with an affixing channel, for affixing therein a connection element, e.g. a corner connection element such as a corner piece. Preferably, the profile provided with at least one further side wall, e.g. the first side wall, the second side wall or the third side wall, is also provided with a further affixing channel. The patent publication BE1022726 describes a profile for the construction of stands having such affixing channels and corresponding connection elements.

The affixing channel allows the profile, a first profile, to be coupled to a further, second profile, e.g. for forming a corner, by applying the connection element, such as the corner connection element, in the affixing channel of the first profile and in the affixing channel of the second profile.

In an embodiment of the profile according to the present invention, the profile, separately or in combination with the affixing channels, is provided with at least one of internal affixing grooves for applying a connection element, such as a corner connection element, such as a corner piece, as described in the patent publication WO2016027175, and passages for applying a connection element as described in the patent publication BE1022807. Such internal affixing grooves and passages also offer the possibility to connect two profile elements, e.g. into a border or corner.

In an embodiment of the profile according to the present invention, the profile is manufactured from extrudable material, e.g. by extrusion.

The profile being manufactured from extrudable material offers the advantage that the profile exhibits a uniform degree of finish over its entire length, as opposed to profiles wherein elements such as the at least one flange are, for instance, cut out manually.

In an embodiment of the profile according to the present invention, the profile is manufactured from one of aluminum, steel, and plastics material.

The advantage of making the profile from aluminum is that the profile is a lightweight element, ensuring effortless manipulation, e.g. when setting up the promotion booth consisting of profiles.

Moreover, the present invention provides a frame for the construction of stands consisting of at least one profile, wherein the affixing surface is provided with the flangingly affixed strip, flanged over by the at least one flanged-over flange. The frame forms the skeleton of a stand, such as a promotion booth, and consists of at least one profile with affixed strip, e.g. a single bar provided with a flangingly affixed lighting strip serving as a frame for a promotion booth.

In an embodiment of the frame according to the present invention, the frame is provided with the booth element, wherein the booth element is one of a curtain, a plate, and lighting.

The advantage of the embodiment in which the frame is provided with the booth element is that the skeleton of the stand is embellished and can be used e.g. at a trade show, e.g. by applying lighting booth elements or by applying a plate or curtain, e.g. for forming a wall.

In an embodiment of the frame according to the present invention, the booth element is bordered by the inner bordering plate surface. More in particular, after applying the booth element to the frame, the booth element, such as the plate, is bordered by the inner bordering plate surface and supported by the bordering plate, reducing the load to be carried by e.g. the strip.

In an embodiment of the frame according to the present invention, the affixing part of the booth element is affixed in the affixing groove. More in particular, after applying the booth element to the frame by applying the affixing part of the booth element in the affixing groove of the profile, the booth element such as the curtain is supported by the affixing groove, reducing the load to be carried by e.g. the strip.

In an embodiment of the frame according to the present invention, the frame is provided with four profiles.

Providing a frame consisting of an assembly of four profiles, e.g. by connecting the profiles using the second affixing groove for forming corner elements, increases the stability of the frame, particularly in the situation where the frame is provided with a booth element such as a plate or a curtain. In the latter situation, the plate and the curtain can be supported from four sides, increasing the stability.

Moreover, the present invention provides a promotion booth consisting of at least one frame. The promotion booth can be set up e.g. at a trade show, wherein the trade show stand is provided with at least one frame, optionally provided with booth elements such as lighting or a plate/curtain, e.g. provided with an advertising message.

Moreover, the present invention provides a method for making the profile for the construction of stands and/or for interior applications and/or for exterior applications according to the present invention. The method comprises the step of manufacturing, e.g. by extrusion, the profile according to an embodiment of the present invention provided with the affixing side wall, wherein the affixing side wall is provided with the affixing surface for affixing the booth element, wherein the affixing surface is bordered by forming at least one flange which extends in an upward direction relative to the affixing surface. The method comprises the step of applying a strip onto the outer surface of the affixing surface. Finally, the method also comprises the step of flanging over the at least one flange so that the strip is flangingly affixed by the at least one flanged-over flange.

The method offers the advantage that the strip can easily be applied onto the affixing surface of the profile, in particular without having to apply a chemical adhesion means such as glue. More in particular, the method allows the strip to be easily applied between the at least one non-flanged-over flange and the affixing surface, and the flange then to be flanged over at least a part of the strip for affixing the strip to the affixing surface. The method thus offers an efficient way for making the profile for the construction of stands according to an embodiment of the present invention.

In an embodiment of the method according to the present invention, the profile is cut off for obtaining a desired profile length and profile shape.

The method of this embodiment offers the advantage that the profile can be cut to measure, e.g. cut at an angle, e.g. for creating congruent profile shapes e.g. for creating a corner element consisting of two obliquely cut profiles.

In an embodiment of the method according to the present invention, the profile is cut off for obtaining a desired profile length and profile shape after flanging over the at least one flange.

This method offers the advantage that when sawing off the profile using a sawing device to achieve a certain profile length and profile shape, no further measures are required for protection of e.g. the sawing device and the profile, e.g. for their protection against the adhesion of chemical adhesion means onto or inside the sawing device and on unforeseen places on the profile, which chemical adhesion means could be released during sawing of the profile e.g. by heating of the chemical means as a result of frictional heat generated during sawing, which chemical adhesion means would be applied onto the affixing surface for affixing the strip. More in particular, the strip is affixed onto the affixing surface of the profile by the at least one flanged-over flange without using chemical adhesion means which could lead to the adhesion of chemical adhesion means onto or inside the sawing device and on unforeseen places on the profile during sawing.

A further advantage of the invention is that the risk of chemical adhesion means adhering inside or onto the sawing device is reduced, which reduces the risk of further detrimental consequences such as the risk of causing an increased rotational resistance of the sawing device.

A further advantage of the invention is that the strip is affixed onto the affixing surface by the at least one flanged-over flange before sawing the profile, as a result of which, when sawing the profile, the strip is sawn to the exact same profile length and profile shape, leading to a precise finish of the profile. Furthermore, the labor-intensive and costly process in which after sawing the profile, the strip is cut off to size and is affixed to the profile in a precise manner, is avoided.

Moreover, the present invention provides a use of the profile according to any of the above embodiments, the present invention providing, more in particular, the use of the profile wherein the profile is cut off for obtaining a desired profile length and profile shape.

The use of the profile described in this embodiment offers the advantage that the profile can be cut to measure, e.g. cut at an angle, e.g. for creating congruent profile shapes e.g. for creating a corner element consisting of two obliquely cut profiles.

In an embodiment of the use of the profile according to the present invention, the profile is used for making a frame.

Making a frame using the profile of the present invention enables the user to construct a skeleton e.g. for a stand in an easy manner.

In an embodiment of the use of the profile according to the present invention, the profile is used by affixing a booth element to the strip.

The use of the profiles of the present invention enables the user to affix booth elements, such as lighting elements, curtains or plates, to the profile in an easy manner, e.g. for creating a stand e.g. for a trade show.

BRIEF DESCRIPTION OF THE DRAWINGS

The invention will be elucidated in further detail by means of the following description and the appended figures.

MODES FOR CARRYING OUT THE INVENTION

Figure 1:
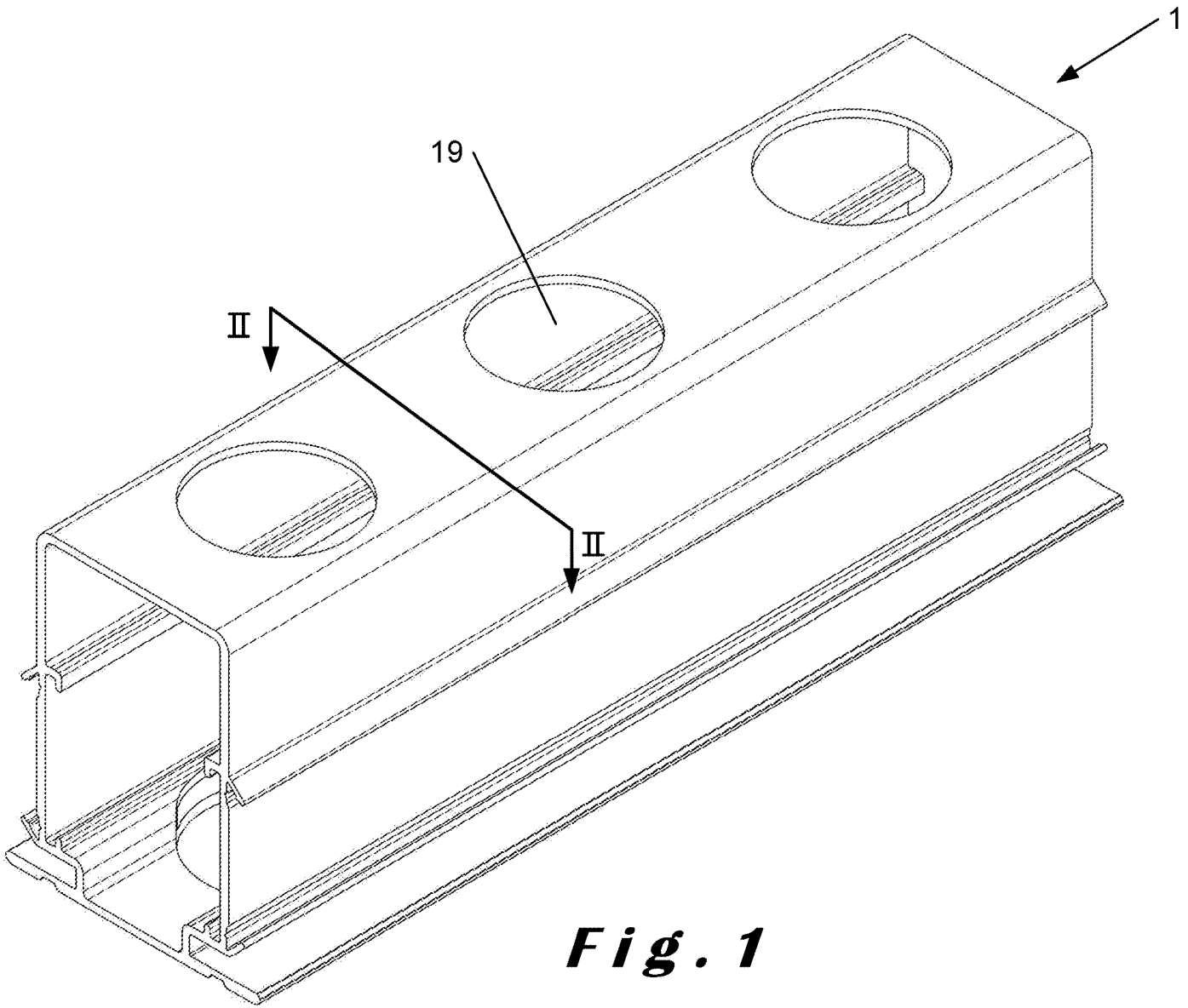
FIG. 1 shows a perspective view of a profile according to an embodiment of the present invention that was cut straight through, wherein the profile is provided with non-flanged-over flanges.

The present invention will hereafter be described with respect to particular embodiments and with reference to certain drawings, but the invention is not limited thereto and is only defined by the claims. The drawings included here are merely schematic representations and are non-limiting. In the drawings, the sizes of some of the elements may be exaggerated, meaning that the parts in question are and not drawn to scale, and are merely for illustrative purposes. The dimensions and the relative dimensions do not necessarily correspond to actual reductions to practice of the invention.

Furthermore, terms such as "first", "second", "third" and the like in the description and in the claims are used for distinguishing between similar elements, and not necessarily for describing a sequential or chronological order. The terms in question are interchangeable under appropriate circumstances, and the embodiments of the invention can operate in other sequences than described or illustrated herein.

The term "comprising" and related terms, as used in the claims, should not be interpreted as being restricted to the means listed respectively thereafter; it does not exclude other elements or steps. The term should be interpreted as specifying the presence of the stated features, integers, steps or components as referred to, while not precluding the presence or addition of one or more other features, integers, steps or components, or groups thereof. Thus, the scope of an expression such as "a device comprising means A and B" should not be limited to devices consisting merely of components A and B. What is meant, by contrast, is that with respect to the present invention, the only relevant components of the device are A and B.

Figure 2:
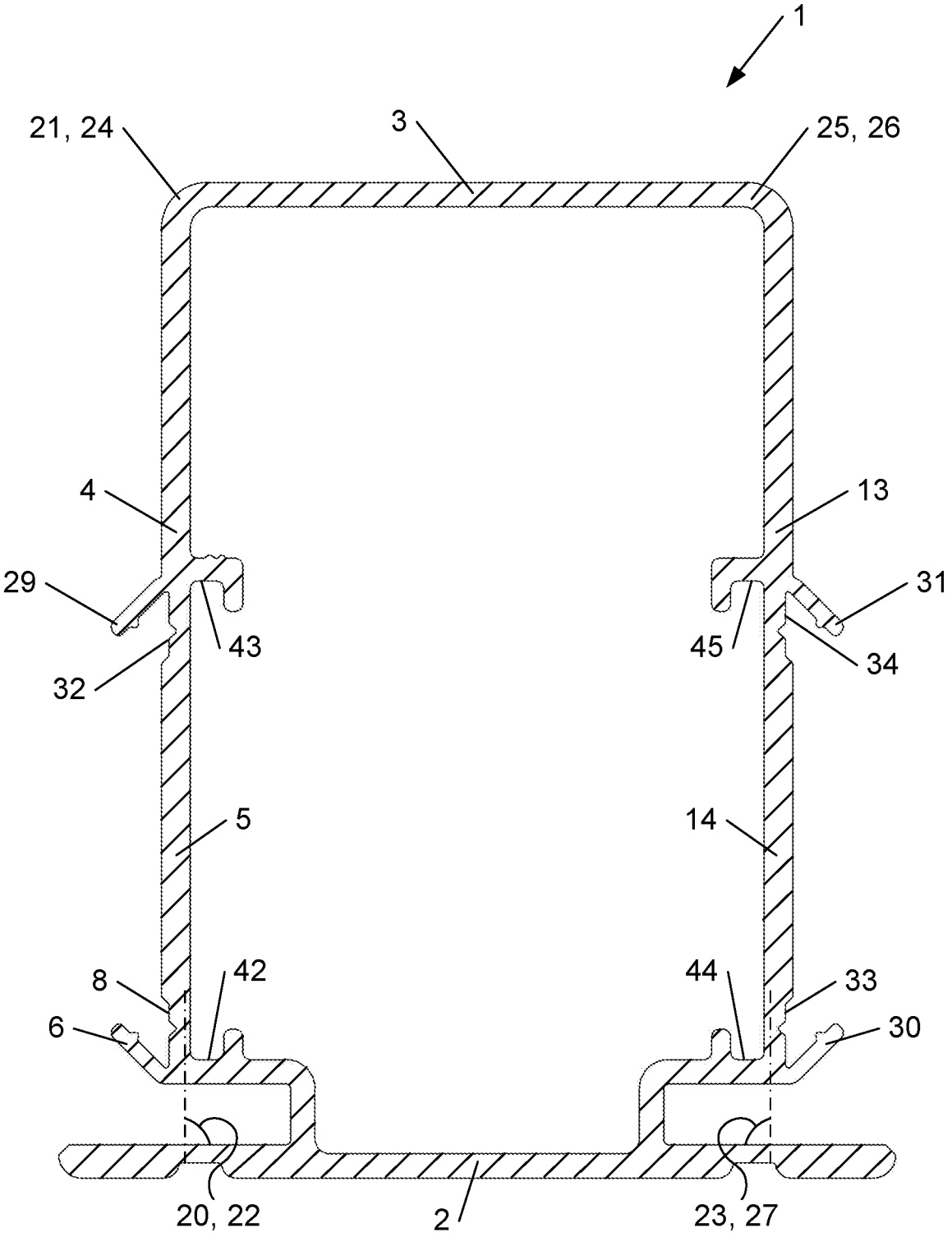
FIG. 2 shows a cross section through the profile of FIG. 1 along a plane perpendicular to the first direction, such as the plane II-II in FIG. 1.
Figure 3:
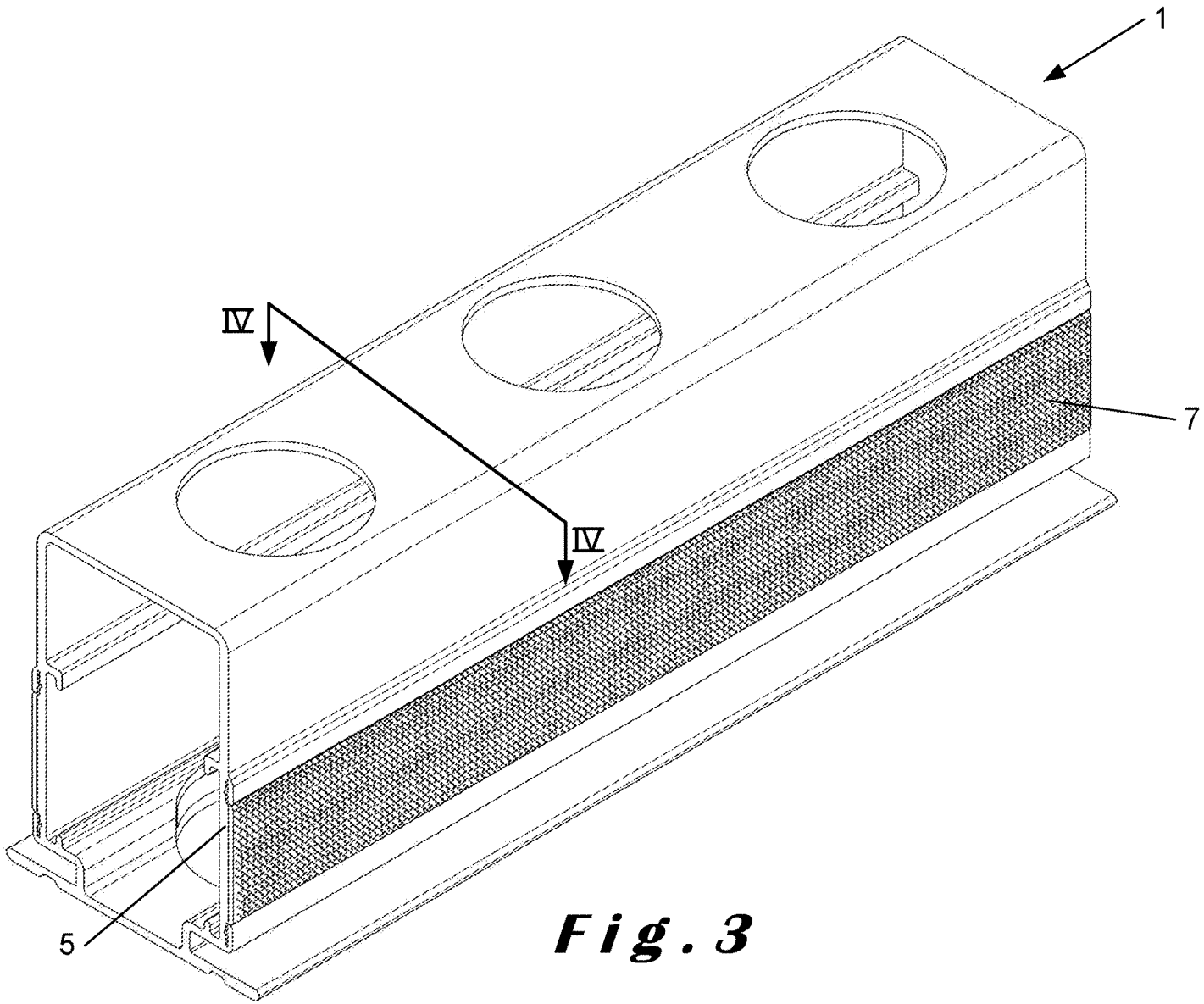
FIG. 3 shows a perspective view of a profile according to an embodiment of the present invention that was cut straight through, wherein the profile is provided with a strip affixed to the affixing surface, flangingly affixed by flanged-over flanges.
Figure 4:
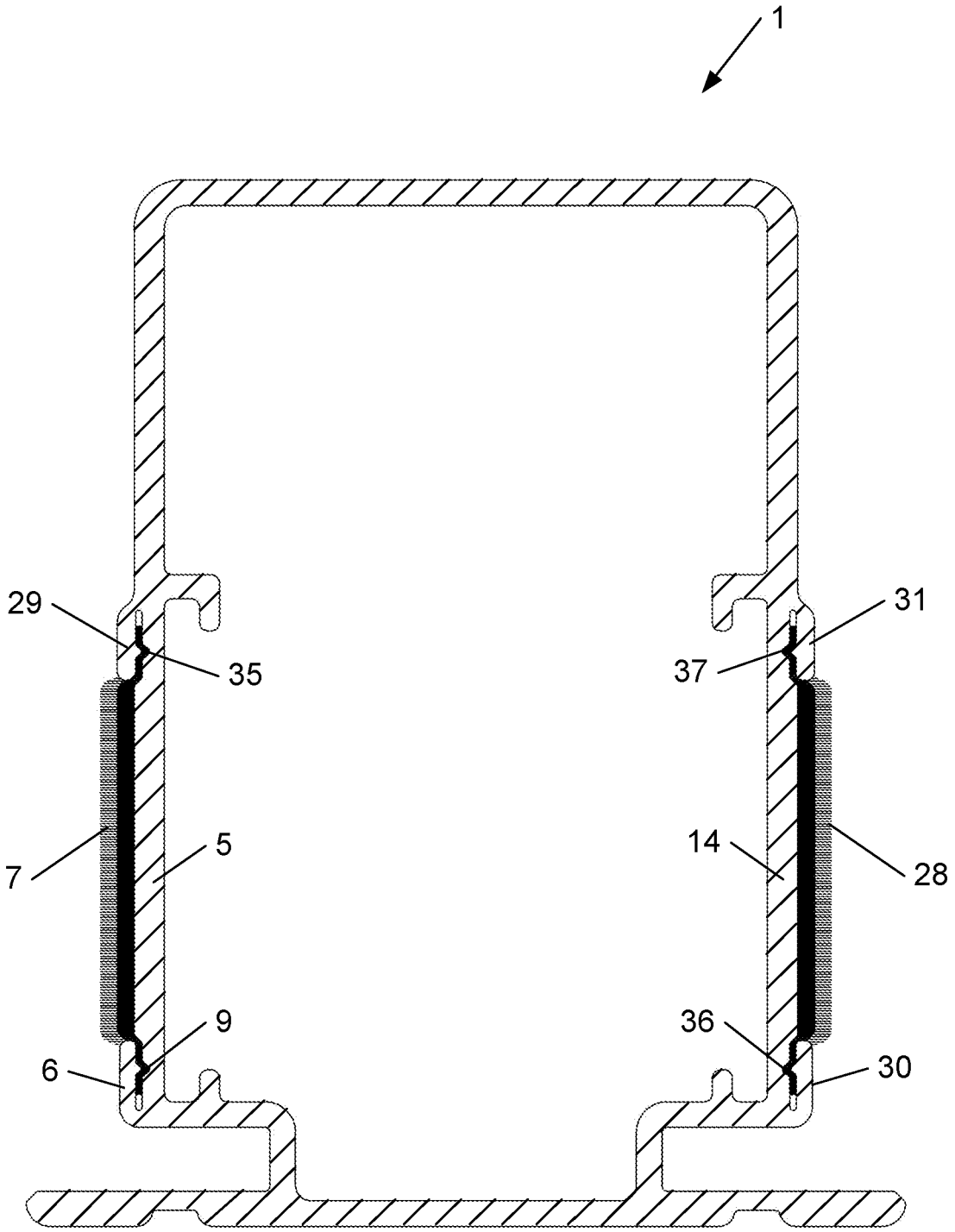
FIG. 4 shows a cross section through the profile of FIG. 4 along a plane perpendicular to the first direction, such as the plane IV-IV in FIG. 3.
Figure 5:
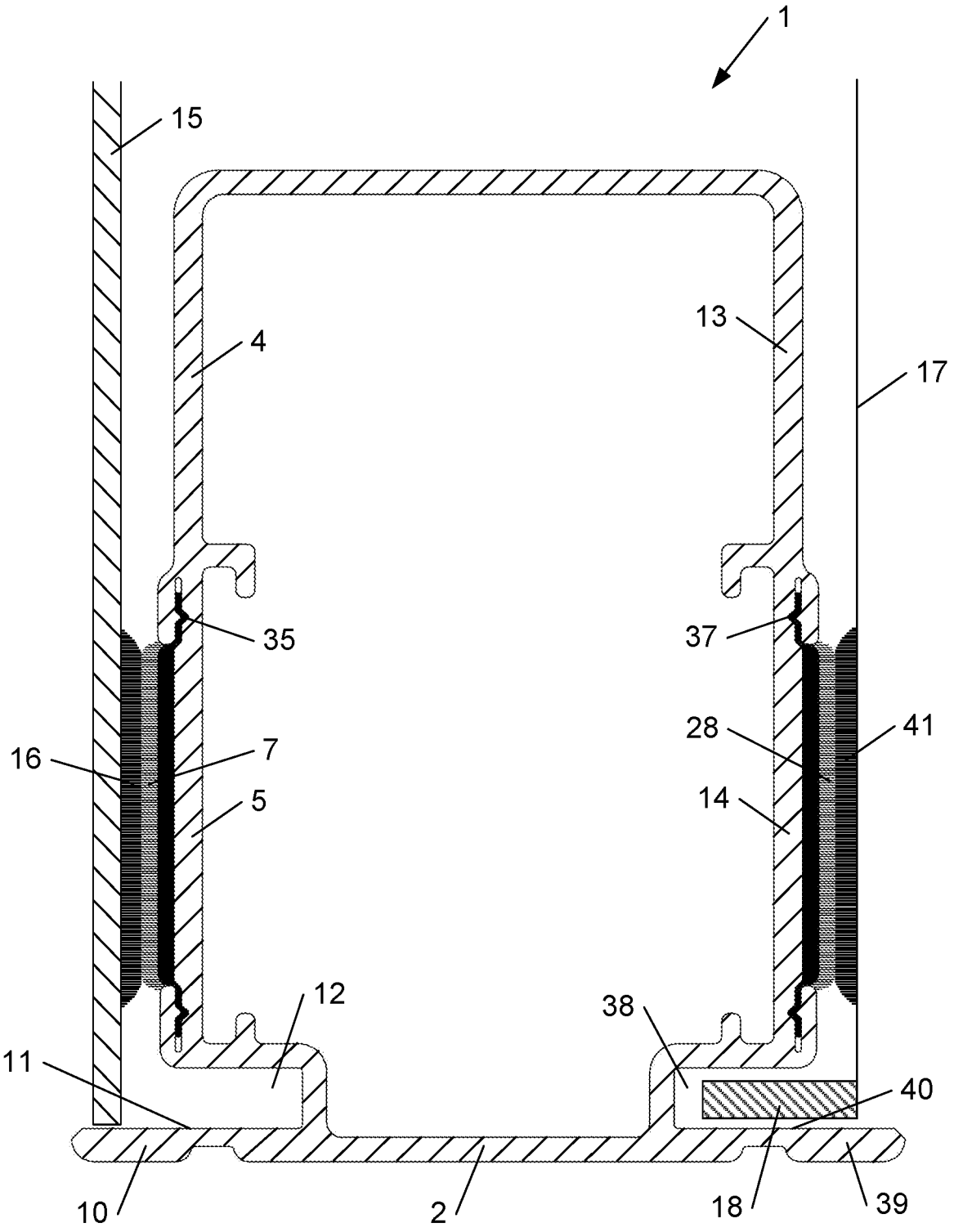
FIG. 5 shows the cross section from FIG. 4, provided with two booth elements, in particular a curtain and a plate.

FIGS. 1-5 show a profile 1 according to an embodiment of the present invention. In FIGS. 1 and 3, the profile 1 is shown in perspective view, wherein the profile 1 is cut straight through in a direction perpendicular to the first direction of the profile 1, being the longitudinal direction of the profile 1. FIGS. 2, 4 and 5 show the profile 1 in a straight cross section, as indicated by the sections II-II and IV-IV in FIGS. 1 and 3, respectively, being a cross section perpendicular to the first direction of the profile.

FIGS. 1-5 show a profile 1 according to an embodiment of the present invention. FIG. 1 shows the profile 1 in a perspective view. A cross section of the perspective view from FIG. 1 according to the intersecting line II-II', perpendicular to the longitudinal direction of the profile, the first direction of the profile, is shown in FIG. 2. The profile 1, as shown in FIG. 2, comprises an affixing side wall 4 provided with a first affixing side wall edge 20 and a second affixing side wall edge 21, a first side wall 2 provided with a first first-side-wall edge 22 and a second first-side-wall edge 23, a second side wall 3 provided with a first second-side-wall edge 24 and a second second-side-wall edge 25, and a third side wall 13 provided with a first third-side-wall edge 26 and a second third-side-wall edge 27 extending along a first direction of the profile 1. The first side wall 2 and the second side wall 3 are located opposite each other and run parallel to each other. The affixing side wall 4 and the third side wall 13 are also located opposite each other and run parallel to each other. The affixing side wall 4 and the third side wall 13 constitute the connection between the edges of the first side wall 2 and the second side wall 3, and are perpendicular to the first side wall 2 and the second side wall 3. More in particular, the first affixing side wall edge 20 and the first first-side-wall edge 22 coincide, the second affixing side wall edge 21 and the first second-side-wall edge 24 coincide, the second first-side-wall edge 23 and the second third-side-wall edge 27 coincide, and the second second-side-wall edge 25 and the first third-side-wall edge 26 coincide.

The affixing side wall 4 of the profile 1 is provided with a first affixing surface 5 on the outer surface of the affixing side wall 4 and the third side wall 13 of the profile 1 is provided with a second affixing surface 14 on the outer surface of the third side wall 13, extending along the first direction of the profile 1.

The first and second affixing surfaces 5, 14 of the affixing side wall 4 and third side wall 13 of the profile 1, respectively, are elk at least partly bordered along the first direction of the profile 1 door parallel flanges such as e.g. protruding edges, e.g. edges protruding in a parallel manner from a plane such as the affixing side wall, in particular first and second flanges 6, 29 bordering the first affixing surface 5 and third and fourth flanges 30, 31 bordering the second affixing surface 14. These flanges are shown in a non-flanged-over state in the FIGS. 1 and 2.

The first and second affixing surfaces 5, 14 of the affixing side wall 4 and the third side wall 13, respectively, of the profile 1 are each provided with two lowered platforms, in particular the lowered platforms 8 and 32 on the affixing side wall 4 and the lowered platforms 33 and 34 on the third side wall 13. These lowered platforms extend along the first direction of the profile 1 over at least a part of the affixing surfaces 5, 14 along each of the flanges 6; 29, 30, 31.

The profile 1 is also provided with a number of passages 19 extending along a second direction through the profile 1, from a first opening in the first side wall 2 to a second opening in the second side wall 3, as shown in FIG. 1. The passages 19 are arranged for passing a connection element therethrough, to connect the profile 1 with other profiles when constructing a stand. Such passages 19 provided in the profiles 1 for connecting the profiles 1 are for instance discussed in the patent publication BE1022807. The profile 1 also comprise internal affixing grooves 42, 43, 44, 45, arranged for affixing e.g. an internal corner connection element such as a corner piece as described in patent publication WO2016027175.

The FIGS. 3, 4 show the profile 1 from the FIGS. 1 and 2, provided with strips 7, 28 affixed to the affixing surfaces 5, 14. FIG. 3 shows the profile 1 provided with a strip in a perspective view. A cross section of the perspective view from FIG. 3 according to the intersecting line IV-IV, perpendicular to the first direction of the profile, is shown in FIG. 4. The cross section from FIG. 4 shows the flanges 6, 29; 30, 31 which are to be flanged over, such as e.g. by bending down the flanges from a state wherein the flanges protrude from the plane, e.g. protruding from the affixing surface, to a state wherein the flanges lie substantially in the plane, e.g. the affixing surface, after the first and second strips 7, 28 have been applied onto the first and second affixing surfaces 5, 14, respectively, of the profile 1, so as to flangingly affix, e.g. tightly pinch, the strips 7, 28, by flanging over the flanges toward the plane, such as the affixing surface, on the affixing surfaces 5, 14. The affixed strips 7, 28, which are flangingly affixed by the flanged-over flanges 6, 29, 30, 31, are shown in FIG. 4. In this figure, strips 7,28 are provided with the hook-and-loop fastener affixing means, e.g. hook-and-loop fastener strips 7, 28 applied to the affixing surface 5, 14. The hook-and-loop fasteners of the strips 7, 28 are provided with the part with hooks or the part with loops.

Each of the flanges 6, 29, 30, 31 applied onto the first and second affixing surfaces 5, 14 is provided with a protrusion arranged along the first direction of the profile 1. Moreover, the affixing surfaces 5, 14 are provided with an indentation arranged along the first direction of the profile 1. As shown in the FIGS. 3 to 5, these protrusions and indentations form interlocking protrusion-indentation sets 9, 35, 36, 37. Conversely, though not shown in the figures, the affixing surfaces 5, 14 can be provided with the protrusion arranged along the first direction of the profile 1, and the flanges 6, 29, 30, 31 applied onto the first and second affixing surfaces 5, 14 can be provided with the indentation arranged along the first direction of the profile 1.

The FIG. 5 shows the cross-section of the profile 1 from FIG. 4, provided with two booth elements, a curtain 17 and a plate 15. These booth elements are provided with strips having the hook-and-loop fastener affixing means, e.g. hook-and-loop fastener strips 16 and 41, applied onto the plate 15 and the curtain 17, respectively. The hook-and-loop fasteners of the profile strips 7, 28 are provided with the part with hooks or the part with loops. To this end, the hook-and-loop fastener is present on the strips 16, 41 of the booth element, provided with the part with loops or the part with hooks, respectively, depending on the part applied to the strips 7, 28 of the profile, so that both parts can become entangled with each other, for said hook-and-loop fastener to be coupled, e.g. by pressing said hook-and-loop fastener 16, 41 with the hook-and-loop fastener comprised in the affixing means of the strips 7, 28 affixed onto the profile 1. In this manner, in FIG. 5, the plate 15 is affixed to the strip 7 of the affixing surface 5 of the affixing side wall 4 and the curtain 17 is affixed to the strip 28 of the affixing surface 14 of the third side wall 13. In other embodiments, the plate 15 and curtain 17 may also be e.g. affixed to the strip 28 of the third side wall 13 and the strip 7 of the affixing side wall 4, respectively.

The affixing side wall 4 and the third side wall 13 of the profile 1 are each provided with an affixing groove 12, 38, extending along the first direction of the profile 1. The affixing groove 38 is arranged for connecting booth elements, such as e.g. the curtain 17, to the profile 1. This is shown, for instance, in FIG. 5, where an affixing part of the curtain 17 arranged thereto, in this case the affixing pin 18, is arranged in the affixing groove 38. The affixing grooves 12, 38 preferably have a predetermined depth, so that the affixing part of the booth element is positionable into the affixing grooves 12, 38 at a depth sufficient to securely attach the booth element to the profile 1.

The first side wall 2 of the profile 1 protrudes on both sides relative to the profile 1 for forming bordering plates 10, 39. These bordering plates 10 comprise an inner bordering plate surface 11, 40, to be used as a border for a booth element, such as e.g. a plate 15, which is affixed by means of a strip, such as e.g. the hook-and-loop fastener strip 16, to the hook-and-loop fastener strip 7 of the profile 1, as shown in FIG. 5. Herein, the length of the bordering plates 10 is preferably chosen so that this length is approximately equal to the total height of the booth element, preferably of the plate together with the strip 7, so that the booth elements can be sufficiently supported on the bordering plates.

LIST OF REFERENCE NUMBERS 1 profile
2 first side wall
3 second side wall
4 third side wall
5 first affixing surface
6 first flange
7 first profile strip
8 first lowered platform
9 first protrusion-indentation set
10 first bordering plate
11 first inner bordering plate surface
12 first affixing groove
13 fourth side wall
14 second affixing surface
15 plate
16 first stand element strip
17 curtain
18 affixing part of the booth element
19 passage
20 first affixing side wall edge
21 second affixing side wall edge
22 first first-side-wall edge
23 second first-side-wall edge
24 first second-side-wall edge
25 second second-side-wall edge
26 first third-side-wall edge
27 second third-side-wall edge
28 second profile strip
29 second flange
30 third flange
31 fourth flange
32 second lowered platform
33 third lowered platform
34 fourth lowered platform
35 second protrusion-indentation set
36 third protrusion-indentation set
37 fourth protrusion-indentation set
38 second affixing groove
39 second bordering plate
40 second inner bordering plate surface
41 second stand element strip
42 first internal affixing groove
43 second internal affixing groove
44 third internal affixing groove
45 fourth internal affixing groove

The invention claimed is:

1. A profile for the construction of stands for affixing booth elements, the profile comprising:

an affixing side wall extending along a first direction of the profile, wherein the affixing side wall is provided with an affixing surface for affixing a strip to the profile between a first affixing side wall edge and an opposite, second affixing side wall edge, which affixing surface extends along the first direction of the profile, wherein the affixing surface is at least partly bordered by at least one flange configured for flangingly affixing the strip by flanging over the at least one flange, and the affixing surface is provided with the strip that is flanged over by the at least one flange such that the strip is pinched between the at least one flange and the affixing surface, wherein the strip comprises affixing means for affixing the booth elements, wherein the affixing means comprises one of hooks and loops of a hook-and-loop fastener set, wherein the at least one flange comprises a first flange and a second flange, wherein the affixing surface is at least partly bordered by the first flange and the second flange and extends continuously between the first flange and the second flange, and wherein the first flange and the second flange are provided on the same affixing side wall.

2. The profile of claim 1, wherein the at least one flange extends along the first direction of the profile.

3. The profile of claim 1, wherein the first and second flanges run parallel to each other.

4. The profile of claim 1, wherein when flanged over the strip, the at least one flange rotates about a rotational axis along the first direction, and wherein the rotational axis lies along the affixing surface.

5. The profile of claim 1, wherein the affixing surface comprises at least one lowered platform which extends along the first direction over at least a part of the affixing surface along the at least one flange.

6. The profile of claim 1, wherein the at least one flange and the affixing surface are provided with at least one interlocking protrusion-indentation set.

7. The profile of claim 1, further comprising:

a first side wall provided with a first first-side-wall edge and a second first-side-wall edge;

a second side wall provided with a first second-side-wall edge and a second second-side-wall edge; and a third side wall provided with a first third-side-wall edge and a second third-side-wall edge, wherein the first side wall, the second side wall, and the third side wall extend along the first direction of the profile, and wherein the first first-side-wall edge, the first second-side-wall edge, the second first-side-wall edge, and the second second-side-wall edge are integral with the first affixing side wall edge, the second affixing side wall edge, the second third-side-wall edge, and the first third-side-wall edge, respectively.

8. The profile of claim 7, wherein at least one of the first side wall, the second side wall, and the third side wall comprises a further affixing surface.

9. A frame comprising the profile of claim 1.

10. A promotion booth comprising the frame of claim 9.

11. A method for making a profile for constructing stands for affixing booth elements, the method comprising:

manufacturing an affixing side wall extending along a first direction of the profile, wherein the affixing side wall is provided with an affixing surface for affixing a strip to the profile between a first affixing side wall edge and a second opposite affixing side wall edge, which affixing surface extends along the first direction of the profile, the affixing surface being provided with a first border by creating a first flange extending in an upward direction relative to the affixing surface and the affixing surface being provided with a second border by creating a second flange extending in an upward direction relative to the affixing surface and the affixing surface extending continuously between the first flange and the second flange, the first flange and the second flange being provided on the same affixing side wall;

applying the strip onto the affixing surface, wherein the strip comprises affixing means for affixing the booth elements, wherein the affixing means comprises one of hooks and loops of a hook-and-loop fastener set; and flanging over the first and second flange so as to flangingly affix the strip by means of the first and second flange.

12. The method for making the profile of claim 11, wherein the profile is cut off for obtaining a desired profile length and a profile shape.

* * * * *